United States Patent [19]

Daniel

[11] 3,961,822

[45] June 8, 1976

[54] FOOTREST FOR DESKS

[76] Inventor: Donald G. Daniel, 1842 Riverford Road, Tustin, Calif. 92680

[22] Filed: Oct. 17, 1975

[21] Appl. No.: 623,399

[52] U.S. Cl. ..... 297/423; 108/50; 211/86; 211/105.6; 248/356; 297/438; 312/194; 312/237

[51] Int. Cl.[2] ..... A47C 7/50

[58] Field of Search ..... 108/50; 182/91, 100, 182/189; 211/86, 105.5, 105.6; 248/356; 272/57 E; 297/423, 425, 427, 438, 439; 312/194, 195, 237, 239

[56] References Cited

UNITED STATES PATENTS

| | | | |
|---|---|---|---|
| 1,203,260 | 10/1916 | Pollard | 108/50 |
| 1,975,004 | 9/1934 | Jenkins | 312/195 |
| 2,903,227 | 9/1959 | Key | 211/86 X |
| 3,089,742 | 5/1963 | Powell | 248/356 X |

*Primary Examiner*—James C. Mitchell
*Attorney, Agent, or Firm*—Fulwider Patton Rieber Lee & Utecht

[57] ABSTRACT

A footrest adapted to be removably mounted in the foot receiving area beneath the top of a desk. The footrest comprises an upper tubular member and a lower tubular member which are slidably connected to each other at one end. Their opposite ends have means for engaging the floor and the underside of the desk top. The tubular members are resiliently urged apart from each other by an internally mounted coil spring to hold the footrest in a vertical position. A foot support member is pivotally connected to the lower tubular member for movement between a horizontal use position and a vertical storage position. It may also be rotated to a position behind the lower tubular member.

8 Claims, 7 Drawing Figures

FIG. 1
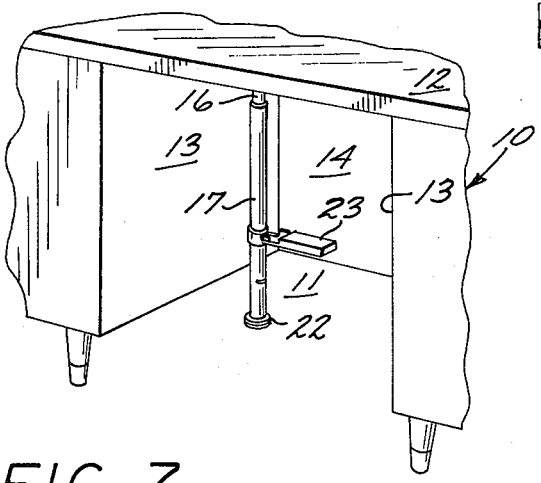
FIG. 2
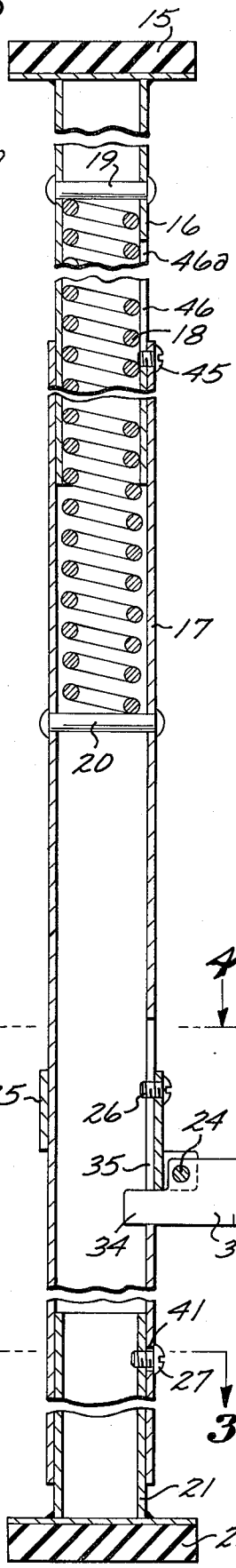
FIG. 7
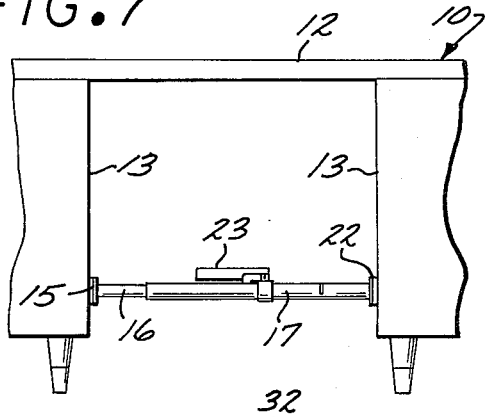
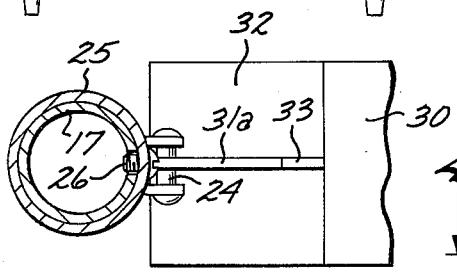
FIG. 4
FIG. 5
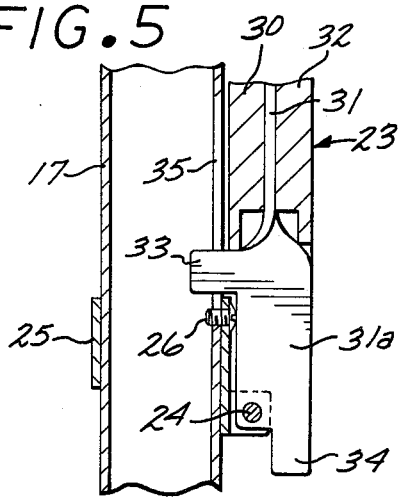
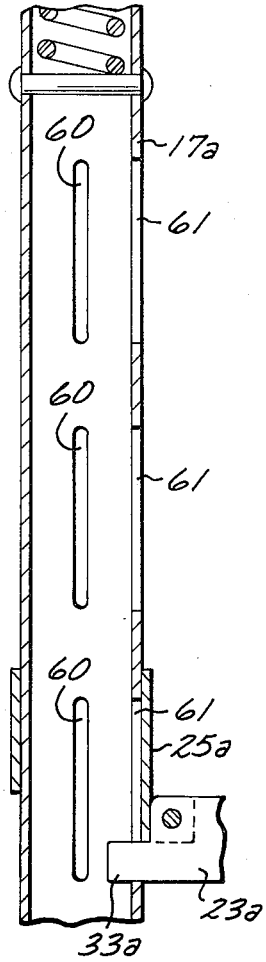
FIG. 6
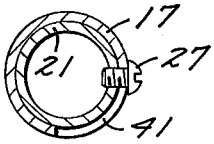
FIG. 3

FOOTREST FOR DESKS

BACKGROUND OF THE INVENTION

1. Field of the Invention

The invention relates to a footrest for use with a conventional desk.

2. Description of the Prior Art

Many persons who work at desks for extended periods of time desire for reasons of health or comfort to elevate their feet. This is customarily done by placing the feet upon a portion of the desk such as an open drawer or the top of the desk.

This type of foot elevation is unsightly to other persons entering the room and consequently embarrassing to the user of the desk. It is also likely to damage the desk structure by putting excessive weight upon it or by scarring its finished surface.

Previous efforts to solve this problem have included foot support devices such as shown in U.S. Pat. No. 1,203,260 which are permanently attached to the sides of the walls defining the leg receiving opening. U.S. Pat. No. 3,244,387 discloses a foot support which is either placed on the top of the desk or on the upper edge of a desk drawer.

SUMMARY OF THE INVENTION

The invention provides a footrest for desks which extends vertically between the floor and the underside of the desk top, preferably adjacent to one side of the foot receiving area of the desk. The footrest comprises a pair of slidably connected tubular members containing a coil spring which resiliently urges the opposite ends of the footrest into engagement with the floor and desk.

The footrest is used with the desk, but is never directly attached to the desk. It accordingly cannot damage the desk in any way and it can easily be removed for use with another desk. The footrest is preferably adjustable as to its length, so that it is capable of being used with any height of desk. The footrest includes a foot support member which is manually movable between a horizontal position for use and a vertical position when not in use. The foot support member is also rotatable so that it can be moved to an out of the way position behind the footrest. The foot support member may also be adjustable as to its height from the floor.

The footrest of the present invention is economical to manufacture and is adaptable for widespread sale and use.

DESCRIPTION OF THE DRAWINGS

FIG. 1 is a perspective view of a portion of a desk showing use of the footrest in the foot receiving area thereof;

FIG. 2 is a longitudinal sectional view of the footrest, partially broken away to shorten the view;

FIG. 3 is a sectional view of the lower portion of the footrest taken on line 3—3 of FIG. 2;

FIG. 4 is a sectional view taken on line 4—4 of FIG. 2, showing a portion of the foot support member in elevation;

FIG. 5 is a partial longitudinal sectional view showing the foot support member in its vertical storage position;

FIG. 6 is a partial longitudinal sectional view of an alternative embodiment of the invention; and FIG. 7 is a front elevational view of a portion of a desk, showing use of the footrest in horizontal position.

DESCRIPTION OF THE PREFERRED EMBODIMENT

A preferred embodiment which has been selected to illustrate the invention is adapted to be used with a conventional desk 10 having a well or leg receiving area 11 disposed beneath the top 12. The leg receiving area 11 is defined by a pair of parallel side walls 13 and a horizontal front wall 14.

The device of the present invention comprises a footrest having an upper circular pad 15, which is preferably formed of suitable resilient material which is adapted to engage the under surface of the desk top 12 without marring or damaging it. The pad 15 is mounted on the top of an upper tubular member 16, the lower portion of which slidably and telescopically fits within the upper portion of a lower tubular member 17.

An elongated coil spring 18 is mounted within the tubular members 16 and 17. The upper end of the coil spring 18 bears against an upper rivet 19 which extends transversely across the upper tubular member 16 and its lower end bears against a lower rivet 20 which extends transversely across the lower tubular member 17.

The lower portion of the lower tubular member 17 fits around a base 21, being secured thereto by a screw 27. The bottom of the base 21 carries a resilient floor engaging pad 22 corresponding to the previously described pad 15.

An elongated foot support member 23 is pivotally mounted at its inner end on a horizontally directed pin 24 which is secured to a collar 25 which is secured to the lower tubular member 17 by a screw 26. The pivotal mounting of the foot support member 23 permits its movement between a horizontal position for use as shown in FIG. 2 and a vertical position for storage as shown in FIG. 5.

The foot support member 23 comprises three layers. A central metal member 31, an upper wooden member 30 and a lower wooden member 32 are all secured together adjacent their midportions by a fastening member 40.

The central metal member 31 is twisted at a 90° angle at its inner end to form a vertically directed portion 31*a*. The vertically directed portion 31*a* has a pair of integral tabs 33 and 34. The tab 33 is directed vertically upwardly when the foot support member is disposed in its horizontal position for use, as shown in FIGS. 1 and 2.

The tab 34 comprises an extension of the inner end of the foot support member which extends through a slot 35 formed in the side of the lower tubular member 17. The lower edge of the tab 34 abuts against the upper surface to the bottom of the slot 35 while the upper edge of the tab 34 simultaneously abuts against the lower edge of the collar 25 to hold the foot support member 23 in its horizontal position, as shown in FIG. 2.

The upper wooden member 30 terminates at the tab 33, but the lower wooden member 32 is slotted to fit around the vertically directed portion 31*a* of the metal member 31 and continues on to terminate adjacent to the pin 24, as shown in FIG. 4.

When the foot support member 23 is to be moved from its horizontal position to its vertical storage position, the foot support member 23 and collar 25 must be moved vertically upwardly a sufficient distance to pivot the foot support member 23 and move the tab 34 out of the slot 35.

As the foot support member 23 is pivoted to its vertical storage position, the tab 33 moves into the slot 35. The foot support member 23 and collar 25 will then move downwardly by force of gravity until the screw 26 abuts against the bottom edge of the slot 35 to prevent any further downward movement.

The screw 27 is disposed in a slot 41 which extends circumferentially around the lower tubular member 17 for a distance of 90°. The slot 41 permits the lower tubular member 17 to be rotated up to 90° to permit rotation of the foot support member 23. In its normal position, the foot support member is disposed on the opposite side of the lower tubular member from the adjacent side wall 13 of the desk. It may be rotated out of the way to a position in which it is disposed directly behind the lower tubular member 17. This rotation may be achieved by rotating the foot support member 23. One of its tabs 33 or 34 engages the side of the slot 35 to cause rotation of the lower tubular member 17 to the extent permitted by the slot 41.

The upper end of the lower tubular member 17 carries a screw 45 which extends into a vertically directed slot 46 formed in the upper tubular member 16. The slot 46 permits downward movement of the upper tubular member against the pressure of the coil spring 18, so that one or both pads 15 and 22 may be retracted for placement of the footrest beneath the desk. They are then urged outwardly under pressure from the coil spring 18 to hold them in engagement with the floor and the underside of the desk top in order to hold the footrest in a vertical position beneath the top of the desk. One or more additional vertically spaced slots **46*a*** may be provided for selective use to adjust the height of the footrest for the particular desk with which it is used.

FIG. 6 of the drawings shows an alternative embodiment of the invention in which a different structure is provided for movement of the foot support member **23*a* to an out of the way position behind the lower tubular member 17*a*. Instead of the circumferential slot 41 of the previous embodiment, the lower tubular member 17*a* is provided with a pair of circumferentially spaced slots 60 and 61 which are disposed 90° apart from each other. The foot support member 23*a* and collar 25*a* may be rotated with respect to the lower tubular member 17 to provide selective use of either slot 60 or 61.**

The lower tubular member may also be provided with a plurality of vertically spaced slots, as shown in FIG. 6 for adjusting the height of the foot support member from the floor.

FIG. 7 illustrates how the footrest can be horizontally disposed in the desk well 11, immediately below the top 12, and with its pads 15 and 22 in engagement with the desk side walls 13, respectively. Such a horizontal arrangement is advantageous in those instances in which the desk 10 includes a drawer (not shown) occupying the upper portion of the well 11. A drawer in this location sometimes interferes with proper seating of the pad 15 in the vertical position of the footrest. However, by orienting the footrest horizontally the footrest can be disposed just beneath such a drawer. In this position the foot support member 23 is preferably pivoted inwardly against the member 17 for better support of the user's foot or feet.

I claim:

1. A footrest adapted to be removably mounted in the foot receiving area disposed beneath the top of a desk, said footrest comprising an upper tubular member and a lower tubular member, said tubular members being slidably and telescopically connected to each other at one end thereof, floor engaging means carried by the opposite end of said lower tubular member and desk top engaging means carried by the opposite end of said upper tubular member for engaging the underside of the top of the desk when said tubular members are disposed within the foot receiving area of said desk, an elongated coil spring mounted within said tubular members, said coil spring urging said floor engaging means and desk engaging means in opposite directions into engagement with said floor and desk top respectively, and a foot support member pivotally connected to said lower tubular member for movement between a horizontal use position in which it extends transversely to said lower tubular member and a storage position in which it extends vertically parallel and closely adjacent to said lower tubular member.

2. The structure described in claim 1, said foot support member being rotatable approximately 90° toward the rear of the desk to move said foot support member into a position behind said lower tubular member.

3. The structure described in claim 2, and means for adjusting the overall vertical length of said tubular members to adjust said footrest to fit various heights of desks.

4. The structure described in claim 3, and means for adjusting the vertical height of said foot support member with respect to said floor engaging means.

5. The structure described in claim 4, said foot support member having a first tab and a second tab, said tabs being directed at right angles with respect to each other, a slot formed in said lower tubular member, said first tab being disposed in said slot when said foot support member is disposed in a horizontal position and said second tab being disposed in said slot when said foot support member is disposed in a vertical position.

6. The structure described in claim 5, said foot support member being pivotally connected to a collar, said collar slidably surrounding said lower tubular member, the upper edge of said first tab engaging the lower edge of said collar and the lower edge of said first tab simultaneously engaging the lower edge of said slot to hold said foot support member in said horizontal position.

7. The structure described in claim 6, and a fastening member securing said collar to said lower tubular member, said fastening member engaging the lower edge of said slot to support said foot support member when said foot support member is disposed in a vertical position.

8. The structure described in claim 7, said foot support member comprising a central metal member secured between upper and lower wooden members, the inner end of said metal member being twisted at a right angle to form a vertically directed portion, said tabs being formed integrally with said vertically directed portion, said vertically directed portion being pivotally connected to said collar.

* * * * *